US006814260B2

(12) United States Patent
Caffrey

(10) Patent No.: US 6,814,260 B2
(45) Date of Patent: Nov. 9, 2004

(54) CONCEALABLE TOY WATER SHOOTER

(75) Inventor: Michael S. Caffrey, Kirkland, WA (US)

(73) Assignee: Badd Boyz Toys, LLC, Kirkland, WA (US)

( * ) Notice: Subject to any disclaimer, the term of this patent is extended or adjusted under 35 U.S.C. 154(b) by 123 days.

(21) Appl. No.: 10/367,219

(22) Filed: Feb. 11, 2003

(65) Prior Publication Data

US 2004/0155064 A1 Aug. 12, 2004

(51) Int. Cl.[7] ..... B67D 5/64
(52) U.S. Cl. ..... 222/175; 222/209; 446/475
(58) Field of Search ..... 222/78, 79, 207, 222/209, 212, 175; 446/473, 475; 472/52

(56) References Cited

U.S. PATENT DOCUMENTS 1,885,180 A * 11/1932 Cameron ..... 222/175
4,997,110 A 3/1991 Swenson
5,072,856 A 12/1991 Kimble
5,158,208 A 10/1992 Wilson
5,303,847 A 4/1994 Cottone
5,484,085 A * 1/1996 Bennett ..... 222/175
5,538,164 A * 7/1996 Rivas ..... 222/153.04
5,678,730 A 10/1997 Fabek et al.
6,325,246 B1 12/2001 Crawford et al.

* cited by examiner

*Primary Examiner*—Gene Mancene
*Assistant Examiner*—Patrick Buechner
(74) *Attorney, Agent, or Firm*—Ipsolon LLP

(57) ABSTRACT

A toy water shooter may be worn in a concealed manner on a user's forearm, beneath clothing. The shooter includes a pressurizable bladder that may be filled with water and which is plumbed to a trigger-operated nozzle mounted on a wrist support. The bladder may be pressurized by pumping an air bulb, which fluidly communicates with the bladder. The trigger is mounted in a position that allows it to be operated by thumb movement. In an alternate embodiment, the bladder may be worn around the user's waist.

20 Claims, 2 Drawing Sheets

CONCEALABLE TOY WATER SHOOTER

TECHNICAL FIELD

This invention relates generally to toy water shooters, and more particularly to a novelty toy water shooter that may be concealed under the user's clothing.

BACKGROUND OF THE INVENTION

Young people of all ages enjoy water fights with toy water guns. As such, it is not surprising there are many, many different types of water shooters available. These run from simple hand-held squirt guns that use trigger-activated pumps to eject water, to more complicated and sophisticated shooters that rely upon pressurized tanks to shoot a stream of water a significant distance.

A concealed water gun adds an extra dimension of fun to water fights. Among other advantages available when the water gun is hidden, the gun may go unnoticed until it is used to douse its target, and if the shooter is clever enough and the concealment good enough, even after the target has been hit. U.S. Pat. No. 4,997,110 discloses a prior concealed water shooter. While the gun disclosed in the '110 patent may be concealed, it relies upon an electric pump powered by batteries and activated by an electric switch to eject water from the nozzle, and such electrical components add complexity to what is essentially a toy novelty.

There is a need therefore for improved toy water shooters, and in particular, concealable water guns.

SUMMARY

A pressurizable bladder is configured for attachment to a user's arm in a concealed position. The bladder has a refill tube for adding water, and an air inlet that is attached to a hand pump for pressurizing the bladder. A nozzle and valve are fluidly connected to the bladder and a trigger is operable to selectively open and close the valve.

In a second illustrated embodiment the pressure bladder is configured for attachment to the user's waist, and the other components are modified accordingly. The hand pump and bladder-refill tube are connected to the bladder with conduits—the hand pump conduit may be extended from the bladder down the user's sleeve and held in one hand, and the nozzle and trigger are held in the user's other hand.

DETAILED DESCRIPTION OF ILLUSTRATED EMBODIMENTS

Figure 1:
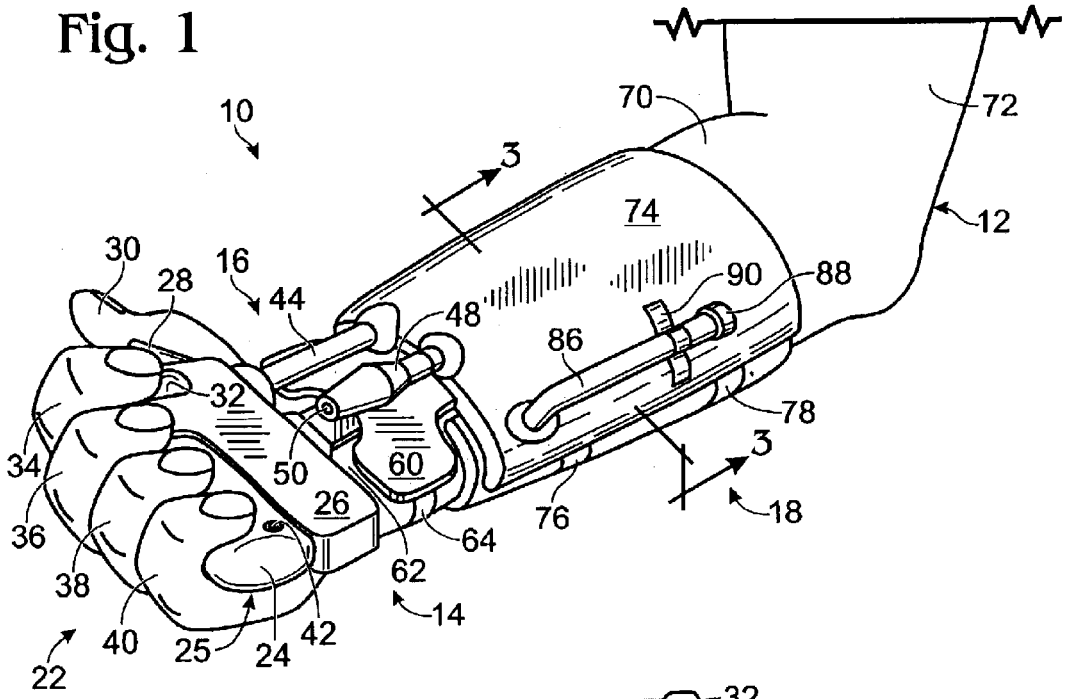
FIG. 1 is a perspective view of one illustrated embodiment of a water shooter according to the present invention as it is worn on the right forearm of a user.
Figure 2:
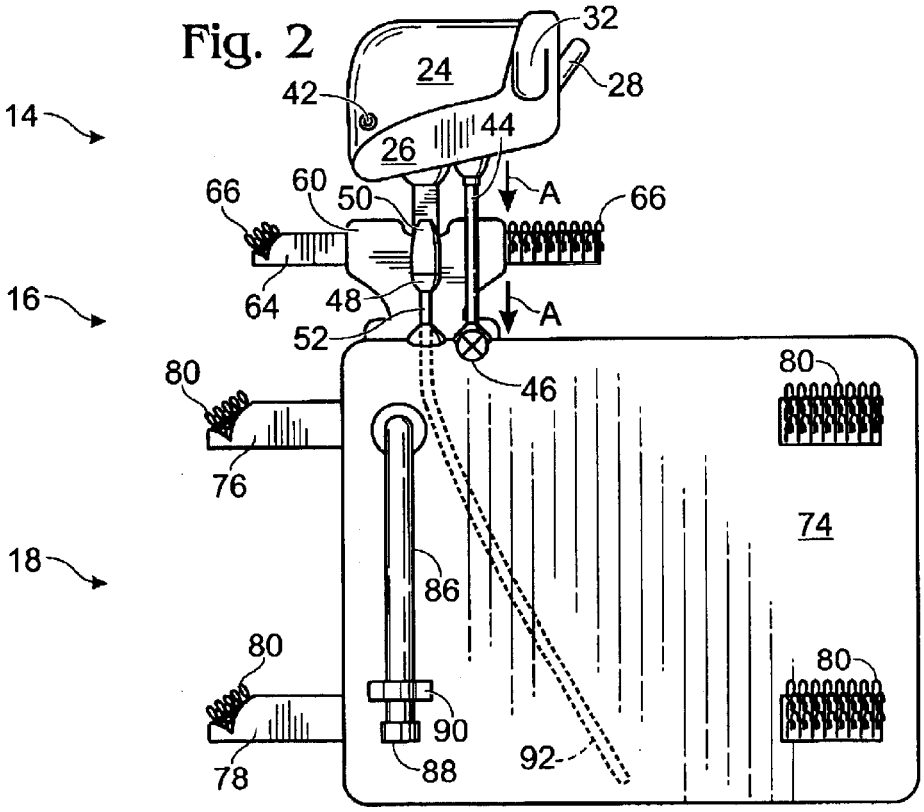
FIG. 2 is a top plan view of the water shooter illustrated in FIG. 1 with the shooter in a flattened position to illustrate the component parts of the shooter.

With reference to FIG. 1, a water shooter 10 is seen as it may be worn on a user's right arm 12. As seen in FIGS. 1 and 2, water shooter 10, which at times herein is referred to as a water gun, comprises three basic components, each of which will be described in detail, namely, a hand piece 14, a wrist piece 16 and an arm piece 18.

Hand piece 14 is ergonomically designed to fit in the palm area 25 of the user's right hand 22 as shown in FIG. 1. Of course, the hand piece may be designed just as well to fit in a user's left hand. Hand piece 14 includes a pressure bulb 24 that is preferably rubber and which is connected to a trigger housing 26, which is preferably a resilient plastic material. A trigger 28 is connected to housing 26 in a position such that the user may activate the trigger with his or her thumb 30 to selectively open and close a valve, as detailed below, to selectively induce or stop a flow of water through a nozzle. Trigger housing 26 and pressure bulb 24 are preferably designed to fit comfortably into the user's palm area 25, so that the user's hand will be more or less naturally curled around the pressure bulb and the trigger housing 26 and will be less likely, therefore, to reveal the presence of the shooter 10. More specifically, trigger housing is configured to follow the normal contours of a human hand and includes a formed indentation 32 where the index finger 34 may rest. In addition to providing an ergonomic design, the indentation allows the user to hold onto the hand piece 14 more firmly, even when the hand piece is wet.

Pressure bulb 24 is a flexible air bulb, preferably fabricated of rubber that is fluidly connected to a bladder in arm piece 18 in the manner described below. As best shown in FIG. 1, pressure bulb 24 is sized to fit into the user's palm area 25 between the trigger housing and the user's middle finger 36, ring finger 38, and little finger 40, and such that the user's fingers naturally curve around the pressure bulb. The pressure bulb 24 is attached to the trigger housing 26 at the interface therebetween, typically with an adhesive material. Pressure bulb 24 includes an air intake opening 42 that is typically a small hole in the bulb, and which functions to allow air to enter the bulb as it is squeezed to pressurize the bladder.

As noted, pressure bulb 24 is fluidly connected through a conduit 44 to the bladder in the arm piece 18. With reference to FIG. 2, conduit 44 extends through trigger housing 26 and connects to pressure bulb 24, although the conduit 44 is not shown in FIG. 2 where it passes through trigger housing 26. A one-way air valve 46 is interposed in conduit 44 at the point where the conduit enters the bladder. One-way air valve 46 allows air to flow from pressure bulb 24 through conduit 44 in the direction indicated by arrow A, through air valve 46 and into the bladder. Air valve 46 is shown schematically in FIG. 2, but will be understood to be any suitable type of one way air valve, and is typically a simple flexible membrane that allows air to flow past the membrane in the direction of arrow A, but which seals against a supporting frame when air pressure forces the membrane in the direction opposite arrow A to prevent backflow.

Trigger 28 is pivotally mounted in trigger housing 26 and is mechanically linked to a water valve 48 so that movement of the trigger from a first, off position, to a second, on position, opens the valve to initiate a flow of water through a nozzle 50 associated with the valve. Trigger 28 is preferably biased into the off position with a suitable biasing device such as a spring, which is not shown. The mechanical linkage between trigger 28 and valve 48 also is not shown, but will be understood to extend internally within trigger housing 26 and is a standard mechanical linkage of any type well known to those of ordinary skill in the art for opening and closing the valve. As detailed below, valve 48 is fluidly connected through a water conduit 52 to the bladder.

Wrist piece 16 serves as a support member for interconnecting the components of hand piece 14 described above with the arm piece 18 and for supporting a water nozzle 50. Specifically, wrist piece 16 comprises a flexible member 60 that resides on the ventral portion 62 of the user's wrist and is held in place by a strap 64 that is attached to the flexible member 60 and which may be wrapped around the wrist. The opposite ends of the strap 64 may be attached to one another with any appropriate fastener such as hook and loop-type fasteners 66. The strap 64 is preferably elastic to better secure the strap and the flexible member 10 the wrist, and to accommodate the differing wrist sizes of different users. Nozzle 50 and a water valve 48, both of which are fluidly connected to a bladder in the arm piece 18 are attached to and supported by the flexible member 60.

Figure 3:
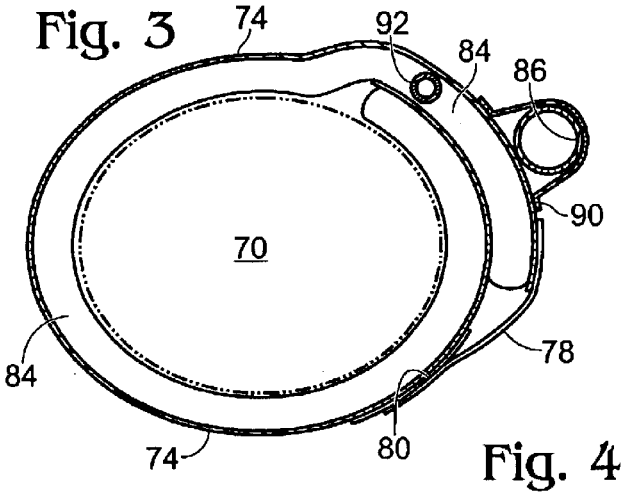
FIG. 3 is a cross sectional view of the water shooter illustrated in FIG. 1, taken along the line 3—3 of FIG. 1.

The arm piece 18 will now be described. Arm piece 18 is a multi-layer flexible member that is designed to wrap around a user's forearm 70 in the area generally between the elbow 72 and the wrist 62. The arm piece includes an outer sheath 74 that is preferably a flexible but resilient and puncture-resistant plastic material that easily and readily accepts printing (so that the arm piece may be emblazoned with logos and the like), and which preferably is water resistant or water proof. Straps 76 and 78 are provided with hook and loop fastener material 80 on opposite ends thereof to allow the sheath 74 to be secured around the user's forearm 70 as shown in FIG. 1. Referring to FIG. 3, a flexible, pressurizable bladder 84 is positioned adjacent the outer sheath 74 on the interior side thereof ("interior" used in reference to the position of the arm piece 18 relative to the user's arm 70) and is affixed to the outer sheath with a suitable adhesive, or other means. The bladder 84 holds water and air, and is accordingly typically fabricated of a plastic material. The bladder defines a water reservoir for the shooter 10. Bladder 84 is fluidly connected to air conduit 44 as described above with a one-way air valve 46, thereby preventing backflow of water and air in conduit 44. Bladder 84 is also fluidly connected to a refill tube 86 that is positioned on the external portion of sheath 74, and which includes a watertight cap 88 and which may be secured to outer sheath 74 with a releasable strap 90.

While in the illustrated embodiment sheath 74 covers only the exterior side of bladder 84, for added protection and durability the sheath may be enlarged to completely enclose the bladder.

A water supply tube 92 resides internally in bladder 84 and has one end attached to a water conduit 52 and the opposite end free in the interior of the bladder. Water conduit 52 provides a fluid pathway from supply tube 92 into water valve 48, and thus to nozzle 50. Nozzle 50 is a standard water nozzle that is attached to and supported by flexible member 60, and valve 48 is a standard water valve. It is to be understood that the particular type of nozzle and valve is not critical and that there are numerous nozzle/valve combinations that are suitable for use with shooter 10. Moreover, while water valve 48 and nozzle 50 are described herein as separate components, combination units suitable for use with the present invention may be utilized.

It should be noted that the outer sheath 74 described above provides protection for the underlying bladder 84 to prevent the bladder from punctures. Because the outer surface of the sheath 74 is smooth, the arm piece 18 is easily concealed under a long sleeve shirt. And as described below, the outer sheath 74 also helps pressurize the water in bladder 84.

Figure 4:
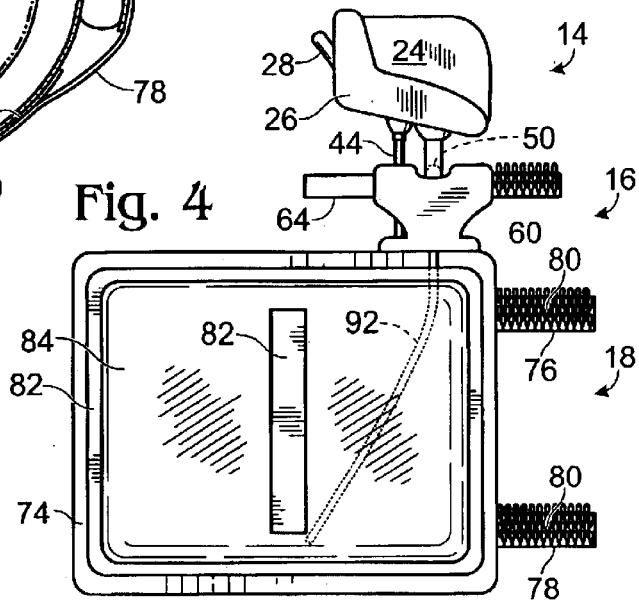
FIG. 4 is a bottom plan view of selected portions of the water shooter illustrated in FIG. 2, showing the side of the shooter that faces the user's arm during normal use.

FIG. 4 shows the inner side of arm piece 18—that is, the side of the arm piece that in use rests against the user's arm. It may be seen in this figure that the peripheral dimensions of bladder 84 are slightly smaller than the peripheral dimensions of outer sheath 74. The bladder 84 is attached to outer sheath 74 in any suitable manner, such as with an adhesive that may be applied to glue zones 82.

Having described the structure of the embodiment shown in FIGS. 1 through 4, the operation of water gun 10 will now be detailed, although operation of the gun is relatively simple and intuitive from the description above. The water gun 10 may be filled and used in any number of ways. One preferred sequence of using the gun follows. The wrist piece 16 or water shooter 10, with bladder 84 empty is attached to the user's wrist as described above with strap 64. The user then fills bladder 84 by filling water into the bladder through tube 86. After the bladder is full, tube 86 is capped off with cap 88 and the tube is secured against outer sheath 74 with strap 90. Arm piece 18 is then secured to the user's forearm as shown in FIG. 1 with straps 76 and 78. The pressure of the straps partially pressurizes the contents of the bladder.

Alternately, the user may begin with the shooter 10 completely removed from the arm, and by filling bladder 84 to capacity with water through refill tube 86. The refill tube 86 is then sealed off with cap 88 and the tube is secured to outer sheath 74 as shown in FIG. 1 with strap 90. The water shooter 10 is then placed around the user's forearm 70 with arm piece 18 on the forearm in the position shown in FIG. 1. The arm piece is then secured snuggly in place with straps 76, 78. The wrist piece 16 is next secured to the wrist, as shown, by attaching the opposite ends of strap 64. Wrist piece 16 supports the nozzle 50, and may thus be secured snuggly onto the wearer's wrist.

In either case, and regardless of the sequence that a particular user relies upon, the arm piece should be worn in a position on the forearm such that the hand piece 14 fits snuggly into the user's palm area 25, as shown. When straps 76, 78 are secured to the outer sheath the water contained in bladder 84 is pressurized to some degree. With the shooter 10 strapped to the user's arm, the bladder is further pressurized by the user repetitively pumping pressure bulb 24 with three fingers, middle finger 36, ring finger 38, and little finger 40. As the pressure bulb 24 is pumped, air is drawn into the pressure bulb through air intake opening 42 and is forced under pressure into conduit 44 (in the direction of arrows A), through one-way air valve 46 and into bladder 84. As air enters bladder 84 in this manner, the pressure in the bladder increases. Because air and water in the bladder cannot flow backwardly through air valve 46, the bladder is quickly pressurized to an internal pressure that is greater than atmospheric pressure.

With bladder 84 filled and pressurized, the user may induce a flow of water through nozzle 50 by moving trigger 28 from the off position to the on position. When the trigger is thus moved, the mechanical linkage linking the trigger to water valve 48 is activated to open the valve, thereby inducing a flow of water through the nozzle. The user can aim the nozzle to direct the spray of water emitted from it onto a desired target. The pressure in bladder 84 provides the energy needed to force water through nozzle 50. The bladder 84 may be pressurized at any time, even with water valve 48 open, by the user continually pumping pressure bulb 24 as described above.

It will be appreciated that a user may easily conceal the water gun 10 under a long sleeve shirt, even one that is fairly tightly fitting since the components of gun 10 conform relatively closely to the user's arm.

Figure 5:
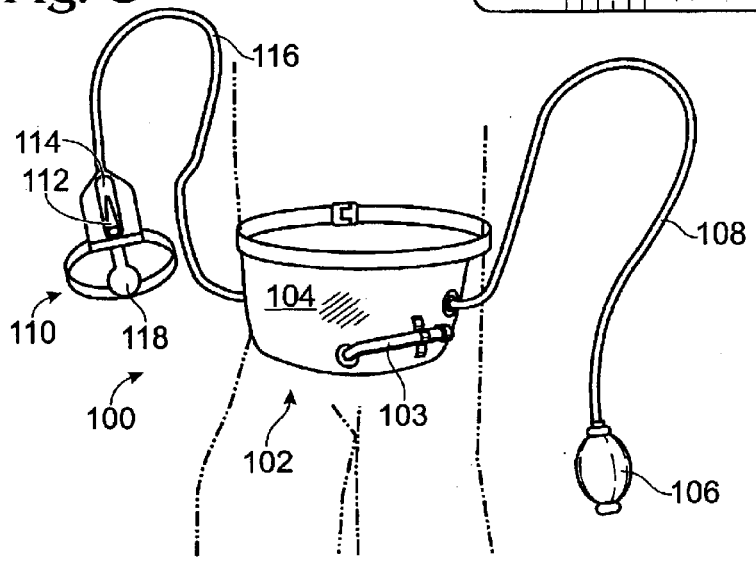
FIG. 5 is a first alternate embodiment of a water shooter according to the illustrated invention in which the water bladder is worn around the user's waist rather than on the user's arm.

An alternative embodiment of a water gun 100 embodying the principles of the invention is shown in FIG. 5.

Relying in part on the foregoing description and on the illustrations of FIGS. 1–4 it will readily be appreciated how the embodiment of water gun 100 is built and functions. Thus, the arm piece 18 of FIGS. 1–4 has been replaced with a waist piece 102, which includes and outer sheath 104, and a bladder contained internally in the waist piece in the same manner as described above with respect to arm piece 18, and includes a bladder refill tube 103. A pressure bulb 106 is fluidly connected to the bladder by way of an air conduit 108, which includes a one-way air valve to prevent backflow. Air conduit 108 may be run, for example, under a user's shirt and down a sleeve for concealment. A wrist piece 110 is worn around the user's wrist and includes a nozzle 112 fluidly connected to a water valve 114, which is activated by a trigger 118. Water is routed from the bladder in waist piece 102 through a water tube 116, which like air conduit 108 may be hidden along the wearer's arm under the sleeve of a shirt. Other structural details of the invention illustrated in FIG. 5 will be readily understood from the foregoing description of the invention of FIGS. 1–4.

Having here described illustrated embodiments of the invention, it is anticipated that those of ordinary skill in the art may make other modifications thereto within the scope of the invention. It will thus be appreciated and understood that the spirit and scope of the invention is not limited to those embodiments, but extend to the various modifications and equivalents as defined in the appended claims.

What is claimed is:

1. A concealable toy water shooter, comprising:

(a) an arm piece attachable to a user's forearm and including;
- a bladder;
- a water inlet defining a fluid inlet into the bladder;
- a water outlet defining a fluid outlet out of the bladder;
- at least one strap for securing the bladder to the user's forearm;

(b) a wrist piece attached to the arm piece and attachable to the user's wrist, including;
- a water valve fluidly connected to the fluid outlet;
- a nozzle fluidly connected to the water valve;

(c) a hand piece attached to the wrist piece and configured for resting in the palm area of the user, including;
- a trigger operatively linked to the water valve for selectively opening and closing the water valve;
- a pressure bulb having an air inlet, the pressure bulb fluidly connected to the bladder through an air conduit;
- a one-way air valve in the air conduit for allowing air to flow from the pressure bulb into the bladder.

2. The concealable toy water shooter according to claim 1 wherein the arm piece further includes a flexible outer sheath member covering the bladder.

3. The concealable toy water shooter according to claim 2 wherein the water inlet extends through the outer sheath and has a tube portion externally of the outer sheath and which is selectively attachable to the outer sheath.

4. The concealable toy water shooter according to claim 1 wherein the wrist piece further includes at least one strap for securing the wrist piece to the user's wrist.

5. The concealable toy water shooter according to claim 4 wherein the wrist piece further comprises a flexible member to which the nozzle is attached and which supports the nozzle.

6. The concealable toy water shooter according to claim 5 wherein the air conduit is attached to and supported by the flexible member.

7. The concealable toy water shooter according to claim 1 wherein the pressure bulb is operable to pressurize the bladder.

8. The concealable toy water shooter according to claim 1 further comprising a trigger housing for mounting the trigger in a position such that the user may activate the trigger with the user's thumb.

9. A concealable toy water shooter comprising:

a pressurizable flexible bladder having a water inlet for filling the bladder with water, and air inlet for allowing air into the bladder, and a water outlet defining a fluid pathway out of the bladder;

an air pump connected to the air inlet through an air conduit for injecting air into the bladder, and a one way air valve in the air conduit that allows air to flow from the air pump through the conduit and into the bladder but prevents air backflow;

a nozzle fluidly connected to the water outlet; and a trigger for selectively opening the nozzle to induce a flow of water from the bladder through the nozzle and closing the nozzle to stop a flow of water from the bladder through the nozzle.

10. The concealable toy water shooter according to claim 9 including a flexible sheath covering the bladder.

11. The concealable toy water shooter according to claim 9 wherein the bladder is configured for attachment to a user's forearm.

12. The concealable toy water shooter according to claim 9 wherein the bladder is configured for attachment to a user's waist.

13. The concealable toy water shooter according to claim 11 wherein the air pump is operable to pressurize the bladder.

14. The concealable toy water shooter according to claim 11 including at least one strap to secure the bladder to the user's forearm to pressurize the bladder.

15. The concealable toy water shooter according to claim 12 wherein the fluid pathway out of the bladder extends to a wrist piece configured for attachment to the user's wrist, and wherein the nozzle and trigger are mounted on the wrist piece.

16. A concealable toy water shooter, comprising:

a pressurizable flexible bladder having a water inlet for filling the bladder with water, and air inlet for allowing air into the bladder, a water outlet defining a fluid pathway out of the bladder, and a flexible sheath member covering at least one side of the bladder, wherein the bladder is configured for attachment to the forearm of a user by wrapping the bladder around the forearm and securing it in place with at least one strap;

a hand-operable air pump connected to the air inlet through an air conduit for injecting air into the bladder, and a one way air valve in the air conduit that allows air to flow from the air pump through the conduit and into the bladder;

a flexible member configured for attachment to the user's wrist and having a nozzle mounted to the flexible member, wherein the nozzle is fluidly connected to the water outlet; and a trigger configured for operation with the user's thumb and linked to the nozzle for selectively opening the nozzle to induce a flow of water from the bladder through the nozzle and closing the nozzle to stop a flow of water from the bladder through the nozzle.

17. The concealable toy water shooter according to claim 16 including a trigger housing mounting the trigger and the air pump.

18. The concealable toy water shooter according to claim 16 wherein the water inlet comprises a tube having a first end fluidly connected to the bladder and a second end with a removable cap.

19. The concealable toy water shooter according to claim 18 including means for attaching the tube to the flexible sheath.

20. The concealable toy water shooter according to claim 16 wherein the sheath further comprises a puncture resistant plastic.

* * * * *